United States Patent [19]

Meinsen et al.

[11] 4,413,493

[45] Nov. 8, 1983

[54] FRANGIBLE LOCK APPARATUS

[76] Inventors: Edward Meinsen, 1126 E. 43rd St.; James Ferretti, 1895 Albany Ave., both of Brooklyn, N.Y. 11210

[21] Appl. No.: 222,350

[22] Filed: Jan. 5, 1981

[51] Int. Cl.[3] ..... E05B 15/16; E05B 63/00

[52] U.S. Cl. ..... 70/422; 70/416; 70/1.5; 411/525; 403/247

[58] Field of Search ..... 70/422, 416, 372, 379 R, 70/380, 237, 258, 379 A, 410, 1.5; 292/336.5, 353, 358, 280; 411/516, 520, 521, 525, 528, 529; 403/256, 247, 254

[56] References Cited

U.S. PATENT DOCUMENTS

| | | | |
|---|---|---|---|
| 1,849,604 | 3/1932 | Weatherhead | 411/521 X |
| 1,971,881 | 8/1934 | Tinnerman | 411/525 |
| 2,113,159 | 4/1938 | Moxley | 403/247 X |
| 2,568,584 | 9/1951 | Hartman | 411/525 |
| 3,336,570 | 8/1967 | Tuchel | 403/254 X |
| 3,597,949 | 8/1971 | Nigrelli | 70/422 |

*Primary Examiner*—Thomas J. Holko
*Assistant Examiner*—Lloyd A. Gall
*Attorney, Agent, or Firm*—Robert D. Farkas

[57] ABSTRACT

A frangible lock apparatus utilizes a pair of pan-shaped washers, each having shaft engaging tines. The shaft portion of a locking device, having the tumbler mechanism rotatably coupled to one end thereof, and the locking portion rotatably engaged the other, is provided with three pairs of notches along its length. Two pairs of such notches engage the pan-shaped washers located on opposite faces of the locking portion of the apparatus. The remaining pair of notches are disposed immediately adjacent the pan-shaped washer located closest to the tumbler end of the shaft. Upon pulling the tumblers, the shaft parts and the remaining portion thereof presents a virtually ungraspable nub and smooth shaped pan washer, accessible only through the small opening formerly used to house the tumbler mechanism.

6 Claims, 6 Drawing Figures

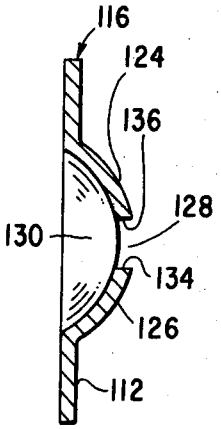
FIG. 5
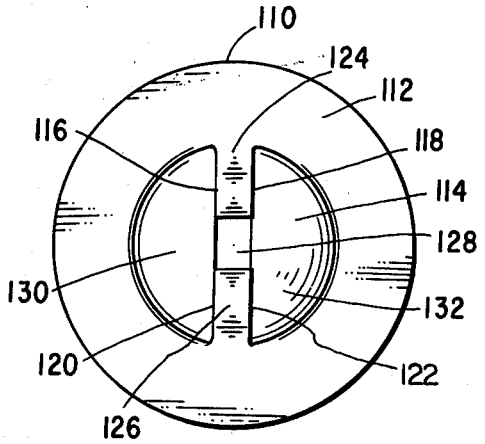
FIG. 4
FIG. 3
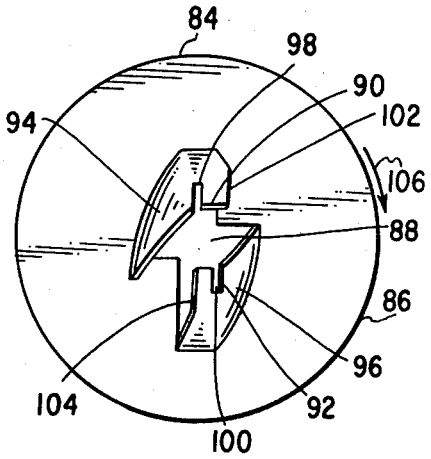
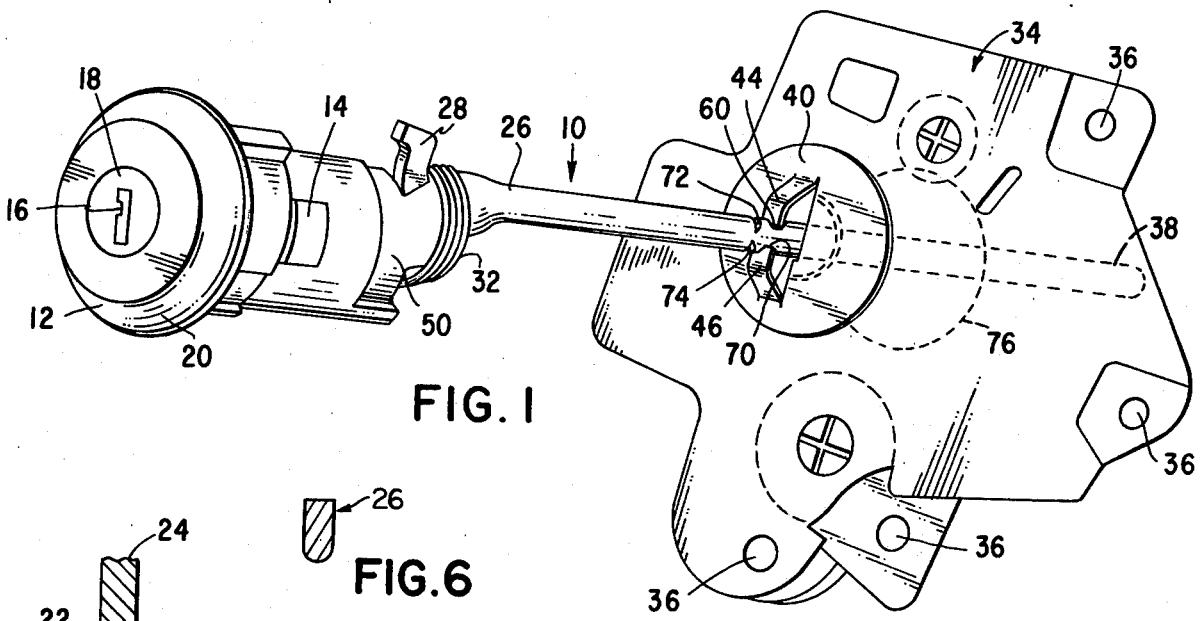
FIG. 1
FIG. 6
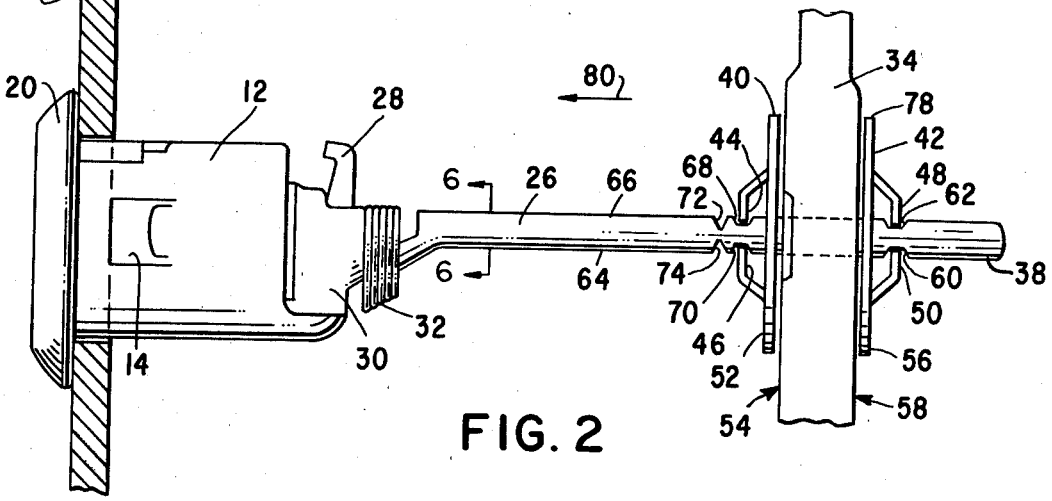
FIG. 2

FRANGIBLE LOCK APPARATUS

BACKGROUND OF THE INVENTION

1. The Field of the Invention

This invention relates to locking devices and more particularly to that class of locking mechanism which, when forced or when tampered with, in an unauthorized fashion, presents a broken mechanism which is substantially tamperproof.

2. Description of the Prior Art

The prior art abound with locking devices, of the pick resistant or tamperproof variety. U.S. Pat. No. 4,056,955 issued Nov. 8, 1977 to D. W. Glass teaches an automobile ignition lock which includes a plug having a plurality of tumblers. The plug is rotatably mounted in a cylinder and includes a slot for receipt of a tumbler actuating key. A key bolt is positioned at the inner end of the key slot and is moveable in response to the insertion of the key in the key slot from a plug locking to a plug unlocking position. Excessive longitudinal transfer or movement of the key bolt relocks the plug and cylinder and prevents relative rotation. Thus, a key with appropriate bitting and of appropriate length must be used to effectuate unlocking the plug from the cylinder. As an additional security feature of the lock, the plug is designed with the circumferential slot that fractures and separates the plug into two separate portions when an attempt to forceably rotate the plug relative to the cylinder. Unfortunately, the glass apparatus may be successfully picked by two successive plug removeable operations. Thus, the lock can be removed by first exerting a longitudinal force to that portion of the plug which is located adjacent the key slot. After removing same, exerting a successive longitudinal force upon the remaining portion of the plug exposes the non-circular portion of the apparatus which is coupled to the locking mechanism of the lock.

U.S. Pat. No. 3,863,476 issued on Feb. 4, 1975 to G. P. Patriquin discloses a cylinder lock of the plug rotatably mounted in a housing and including key way for receiving a key. A cam actuator operates the lock controlling cam and is rotatably mounted in the housing behind the plug and receives the end of the key as it passes through the plug. One or more remaining restraining wafers interact with the proper key and releasably hold the cam actuator in a lock position with respect to the housing. Restraining wafers in the plug maintains it in a preselected position with respect to the cam actuator and the housing. A proper key is received by both the plug and cam actuator and releases both for rotational motion to unlock the device and supplies torque to both therefor. Attempting to pick the subject lock in the normal manner only releases the plug from the cam actuator and thus the lock remains locked. The spline arrangement is such that the cam actuator cannot be picked without first picking the plug, thus, rendering the lock time consuming to pick even for one familiar with its construction. Auxiliary splines are provided and the wafers can define contoured edges for interacting the plurality of splines simultaneously. However, once the plug portion has been released the cam actuator remains and may be operated upon the insertion of a screwdriver in the housing through the passageway formerly retaining the plug. Deficient force, if employed, may override the restraining forces provided by the restraining wafers, thus providing for easy rotation of the lock controlling cam.

U.S. Pat. No. 4,008,588 issued on Feb. 22, 1977 to H. C. Miller et al. discloses a key operated rotary plug cylinder lock having rotary disc tumblers with a concentric cylindrical boss on one face of each disc tumbler projecting actually into internesting rotation into a complemental cylindrical well or recessed in the confronting face of the next adjacent disc tumbler. A lock out pin mechanism to lock the plug against rotation when excessive rearward stress is exerted thereon and a frangible lost motion coupling between the tumblers and the shell portion of the plug breakable upon excess torquing forces are also provided. The apparatus is only effective upon the use of a cylindrically shaped key and can be successfully picked upon crude alignment attempts of the rotary disc tumblers, sufficient to allow an L-shaped instrument passing therethrough. Upon pulling out each or all of the disc-shaped elements, the shell portion of the plug is accessible for rotation by the simple insertion of a large tool, such as the broad face of a screwdriver.

SUMMARY OF THE INVENTION

A primary object of the present invention is to provide a locking mechanism which, when tampered with, cannot be easily operated into the open position.

Another object of the present invention is to provide a locking mechanism suitable for mounting for motor vehicles, particularly resistant to tumbler pulling operations, now frequently found to be the most popular method for ingress into unauthorized portions of a vehicle.

Still another object of the present invention is to provide a locking apparatus which, when tampered with, can be opened by authorized personnel, but only after sufficient time has elapsed to permit such authorized opening.

Yet another object of the present invention is to provide a lock device which, when tampered with, can be utilized to the extent that the untampered with portions remain intact and thus, reusable.

A further object of the present invention is to provide an inexpensive locking mechanism which can be installed in the place of existing mechanisms without substantially increasing the cost, without requiring new tumblers or keys therefor.

Another object of the present invention is to provide a kit of parts, suitable for addition to existing locking mechanisms, so as to make same tamperproof or minimally, tamper resistant, without requiring great skill or complex or expensive tools therefor.

Heretofore, pick proof locks relied upon several techniques for their success. Frangible lock components, when broken, tend to frustrate the unauthorized person in his attempt to gain access. However, sophisticated burglars and other unauthorized individuals quickly learn how to utilize additional tools and additional steps to override and manipulate the remaining broken portion of the lock so as to rapidly gain access.

The present invention contemplates these problems and successfully overcomes the same by utilizing a mechanism, when parted, leaves behind a smooth, virtually cup-like shaped device, which device only is accessible through the tumbler housing. By its construction, the cup-like remaining washer resists both inward and outward dislodging forces and is ungraspable by conventional means. Thus, the locking portion of the lock will remained locked despite the tumblers having been pulled.

These objects as well as other objects of the present invention will become more readily apparent after reading the following descriptions of the accompanying drawings.

BRIEF DESCRIPTION OF THE DRAWINGS

FIG. 1 is a perspective view of the present invention.

FIG. 2 is a side elevational, partial cross sectional view of the apparatus shown in FIG. 1.

FIG. 3 is an alternate embodiment of a portion of the apparatus shown in FIG. 1.

FIG. 4 is a front elevation view of still another alternate embodiment of a portion of the apparatus shown in FIG. 1.

FIG. 5 is a side elevation view of the apparatus shown in FIG. 4.

FIG. 6 is a partial cross-sectional view of non-circular shaft 26, shown in FIG. 2, viewed in the direction of arrows 6—6.

DESCRIPTION OF THE PREFERRED EMBODIMENT

The structure and method of fabrication of the present invention is applicable to locks, having a tumbler portion, a non-circular shaft portion, and a locking mechanism. The tumbler portion is provided with a tumbler, of conventional design, including having a key receiving slot therein. The tumbler housing may be provided with clamping or locking means to a portion of the surface of the panel to which it is intended to be secured. The tumbler mechanism is coupled to one end of a non-circular shaft. Thus, when the tumbler mechanism is successfully rotated upon the insertion of the properly bitted key, tumbler mechanism and the non-circular shaft rotate together. The locking mechanism, usually fastened to an opposed surface of the panel, is provided with a non-circularly shaped opening, into which a non-circular shaft resides. When the non-circular shaft rotates, the non-circular openings similarly rotate, causing the locking mechanism to be operated into an out of a locked condition.

In conventional automotive use, the tumbler housing is secured to an external surface of the vehicle, such as a trunk lid or a door exterior panel. Clamping tines are frequently employed for securing the tumbler housing to the door or lid panel. A rectangularly shaped cross sectioned shaft is coupled to the inner end of the tumbler assembly, oft times being pivotably secured thereto. The distal end of the non-circular rectangularly shaft engages the rectangular opening of the locking mechanism. Such rectangular opening is oft times misaligned coaxially with the longitudinal central axis of the tumbler assembly.

One of the most common ways in which an unauthorized person gains access to the interior portions of a motor vehicle is to utilize tools having a screw-like thread disposed at the free end thereof. By exerting a quick and sudden inward force, on the point of such screw shaped thread, when engaged into the mouth of the key receiving tumblers, the screw is caused to bite into the key receiving slot. By then exerting a strenuous outward force, all of the tumblers may be quickly and cleanly pulled upwardly from the lock. Normally, the non-circular shaft is similarly and simultaneously pulled outwardly from the locking mechanism portion of the lock. The thief simply then simply inserts the screwdriver blade into the rectangularly shaped shaft receiving opening, and upon rotation of the screwdriver, causes the lock to be opened. The entire operation can take less than fifteen seconds without noise or without use of external forms of energy.

The present invention contemplates the popularlity of the tumbler removing step of the burglary process and recognizes that little, if anything, can be done to deter same. However, by preventing the screwdriver blade turning operation, the thief will be totally thwarted in his attempt to gain illicit access to the interior of the vehicle. This is accomplished by causing the non-circular shaft to be weakened at a location adjacent the face of the locking mechanism located closest to the tumbler mechanism. By retaining the broken portion of the non-circular shaft, within locking mechanism, and by providing only a smooth rounded surface that is accessible only through the tumbler receiving opening, the thief is compelled to attempt to grasp such smooth surface with a pair of pliers. This is almost impossible to do, and when coupled with the inability of the thief to insert a screwdriver tip into a convenient slot, the thief is compelled to then attempt time consuming and noticeable acts.

The apparatus of the present invention includes two pan-shaped washers, each having a flat brim-like portion, and each having a rectangular shaped opening disposed in the crown portion of the washer. The crown portion of the washer is provided with two tines adapted to engage two notches on opposite edges of the rectangularly shaped, non-circular shaft. It should be noted that forcing the shaft towards the brim portion of the washer causes the tines to bite ever deeper into the notches. One of such washers is installed on each opposed external base of the locking mechanism. Another set of notches are disposed into opposed edges of the rectangularly shaped cross section of the non-circular shaft at a location immediately adjacent to the tine receiving notches of the washer disposed intermediate the locking mechanism and the tumbler housing. Thus, when tumblers are "pulled", the rectangular shaft separate leaving behind a small nub, extending slightly outwardly from the crown of the pan-shaped washer exposed only through the tumbler receiving opening of the tumbler housing. The remaining portion of the non-circular shaft remains intact within the locking mechanism resisting efforts to force the remaining portion of the shaft both inwardly and outwardly from the locking portion of the lock and refusing to provide a grasping surface. The only way in which the thief may gain entry into the motor vehicle or, if desired, only other form of habitation, such as a house, trailer, building, or the like, is by way of dislodging the remaining portion of the non-circular shaft or by grasping the smooth exterior surface of the pan-shaped washer closest to the thief. Since both operations are virtually impossible without attracting attention or without causing extended periods of time to be devoted to this procedure, the present invention successfully resists this mode of illicit entry.

It should be noted that a conventional lock may be employed simply by adding three pairs of notches to the non-circular shaft portion thereof, and by installing two pan shaped washers at the correct locations. Further, it can be seen that the locking portion of the lock remains totally effective after an aborted breaking attempt, requiring the owner of the vehicle or domicile to simply replace those portions of the tumbler mechanism destroyed by the thief. Naturally, the present invention can be utilized in new installations by installing locking devices properly equipped with the two pan-shaped washers. As can readily be seen, the two pan-shaped washers are extremely inexpensive and yet totally effective in its intended purposes.

Now referring to the figures, and more particularly to the embodiment illustrated in FIG. 1 showing locking apparatus 10 can be seen having a tumbler receiving housing 12 complete with external panel gripping fingers 14. Key receiving slot 16 is disposed within tumbler barrel 18. Lock face portion 20 is mounted outwardly of face 22 of exterior panel 24. Non-circularly shaped shaft 26 is shown having end 28 thereof engaged with rotatable portion 30 of tumbler housing 12. Spiral shaped spring 32 retains end 28 of rectangularly shaped shaft 26 is rotational coupling with end 30 of the tumblers. Locking mechanism portion 34 is provided with locking tongue 36. Mechanism 34 may be mounted to other portions of the motor vehicle, utilizing holes 36 therefor. End 38 of non-circular shaft 26, passes through a non-circular opening, not shown, which when rotated, causes locking portion 34 to be operated into and out of a locked condition.

A pair of pan-shaped washers 40 and 42 are provided, each having opposed jaw-like tines 44, and 46, as well as tines 48 and 50. Washer 40 is installed having brim portion 52 engaging surface 54 of locking portion 34. Similarly, brim portion 56, of pan-shaped washer 42, is installed engaging surface 58 of locking portion 34. Notches 60 and 62, each disposed in opposed relationship and lower and uppermost edges 64 and 66 of non-circular shaft 26 respectively. Tine 48 engages notch 62 whilst tine 50 engages notch 60. Similarly, notch 68 is installed in edge 66, directly opposite to notch 70, installed in edge 64. Tine 44 engages notch 68. Tine 46 engages notch 70. Notches 60, 62, 68 and 70, each have widths slightly greater than the thickness of tines 48, 50, 44 and 46. Notch 72 is disposed in edge 66 immediately adjacent to notch 68 at a location intermediate end 28 of non-circular shaft 26. Notch 74 is installed in edge 64, opposite to notch 72, and is located immediate adjacent to notch 70. Dotted lines 76 represent the marginal edge 78 of circular pan-shaped washer 42.

On applying of force, in the direction of arrow 80 to housing 12, end 28, of non-circular shaft 26, is separated from end 38 thereof, at the location of a break extending between notches 72 and 74. Remaining are the small portion of non-circular shaft 26 extending outwardly from notches 68 and 70. Forces exerted on end 38, of non-circular shaft 26, directed in a direction opposite to arrow 80, by application on the broken edge located at and in between notches 72 and 74, caused tines 44 and 46 to bite into and more successfully engage notches 68 and 70. Attempts to grasp the nub portion of shaft portion 38, extending outwardly from pan-shaped washer 40, will be unsuccessful due to a fore-shortened profile thereof.

FIG. 3 depicts an alternate embodiment of pan-shaped washer 40, as shown. Here, washer 84 is shown having a circular brim-like portion 86 in which resides rectangular opening 88. Tines 90 and 92 are separated from semi-hemispherical portions 94 and 96, by slots 98 and 100. Exposed edges 102 and 104 may be grasped by the jaws of a pair of elongated pliers, not shown. However, washer 84 would be effective only if operated in the direction of arrow 106. A pair of pliers would not be effective in rotating washer 84 in the direction of arrow 106, inclusive of any remaining portion of non-circular shaft 38, not shown, then being grasped by tines 90 and 92.

Still another embodiment of a pan-shaped washer, useful in the present invention is shown in FIG. 4 and is denominated washer 110. Here, brim portion 112 completely surrounds a perfectly hemispherical dome-like portion 114. Slots 116, 118, 120, and 122, define tines 124 and 126. Rectangularly shaped opening 128 admits of the introduction of a non-circular shaft, not shown. Tines 124 and 126 have the external surfaces thereof smooth and contiguous with the external surface portions of semi-hemispherical portions 130 and 132. Portions 130 and 132 rigidly extend outwardly from brim portion 112. The entire apparatus is unitary in construction.

FIG. 5 illustrates rectangular opening 128 passing through and separating groove engaging edges 134 and 136, of tines 124 and 126. Pan-shaped washer 110 represents a washer whose shape is most resistant to grasping by any form of grasping tool, such as pliers, or wrenches.

FIG. 6 illustrates a cross-sectional view of shaft 26, shown to be virtually rectangular in shape. A fully rectangular cross-section or even a circular cross-section may be employed, as opposed to the rectangular shape, having one side thereof rounded, if desired.

One of the advantages of the present invention is a locking mechanism which, when tampered with, cannot be easily operated into the open position.

Another advantage of the present invention is a locking mechanism suitable for mounting in motor vehicles, particularly resistant to tumbler pulling operations, now frequently found to be the most popular method for ingress into unauthorized portions of a vehicle.

Still another advantage of the present invention is a locking apparatus which, when tampered with, can be opened by authorized personnel, but only after sufficient time has elapsed to permit such authorized opening.

Yet another advantage of the present invention is a lock device which, when tampered with, can be utilized to the extent that the untampered with portions remain intact and thus, reusable.

A further advantage of the present invention is an inexpensive locking mechanism which can be installed in the place of existing mechanisms without substantially increasing the cost, without requiring new tumblers or keys therefor.

Another advantage of the present invention is a kit of parts, suitable for addition to existing locking mechanisms, so as to make same tamperproof or minimally, tamper resistant, without requiring great skill or complex or expensive tools therefor.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A frangible lock apparatus comprising a tumbler, a housing, said tumbler journaled for rotation within said housing, a non-circular shaft, one end of said non-circular shaft coupled for rotation with said tumbler, a locking mechanism, said locking mechanism having an opening for receiving a portion of said non-circular shaft therein, a pair of pan-shaped washers, said locking mechanism having opposed lateral surfaces, each of said pair of pan-shaped washers having a brim portion and a pair of opposed jaw-like tines, said jaw-like tines having free ends, said free ends of said jaw-like tines disposed in opposed spaced apart relationship, said non-circular shaft having a first pair of notches and a second pair of notches and a third pair of notches, one of said pair of pan-shaped washers being disposed having said brim portion thereof adjacent to one of said opposed surfaces, the other of said pair of said pan-shaped washers having said brim portion thereof disposed adjacent the other of said pair of pan-shaped washers engaging said first pair of notches, said free ends of said other pan-shaped washers engaging said second pair of notches, said third pair of notches being disposed at a location immediately adjacent to said second pair of notches and disposed intermediate said locking mechanism and said housing, wherein said non-circular shaft is breakable in the region of said third pair of notches, upon the application of force exerted in tension upon said non-circular shaft.

2. The apparatus as claimed in claim 1 wherein said each of said pair of pan-shaped washers comprise unitary construction.

3. The apparatus as claimed in claim 1 wherein said each of said pair of pan-shaped washers comprise a dome-like shape extending outwardly from one of a pair of opposed lateral surfaces of a brim-like portion of said washer, a non-circularly shaped opening disposed in said dome-like shape, two pairs slots, each of said pairs of slots extending through portions of said dome-like shape and being disposed in parallel and in spaced apart relationship with one another, adjacent pairs of each of said two pairs of slots being coaxially aligned.

4. The apparatus as claimed in claim 1, wherein said first and said second pairs of notches have a width greater than the thickness of said jaw portions of said pairs of tines.

5. The apparatus as claimed in claim 1 wherein said third pair of notches extend a greater distance into said non-circular shaft than do said first and said second pair of notches.

6. The apparatus as claimed in claim 1 wherein said pair of pan-shaped washers each have circularly shaped marginal edges.

* * * * *